US008857186B2

(12) United States Patent
Held

(10) Patent No.: US 8,857,186 B2
(45) **Date of Patent: *Oct. 14, 2014**

(54) HEAT ENGINE CYCLES FOR HIGH AMBIENT CONDITIONS

(75) Inventor: Timothy James Held, Akron, OH (US)

(73) Assignee: Echogen Power Systems, L.L.C., Akron, OH (US)

( * ) Notice: Subject to any disclaimer, the term of this patent is extended or adjusted under 35 U.S.C. 154(b) by 364 days.

This patent is subject to a terminal disclaimer.

(21) Appl. No.: 13/291,086

(22) Filed: Nov. 7, 2011

(65) Prior Publication Data

US 2012/0131921 A1 May 31, 2012

Related U.S. Application Data

(63) Continuation-in-part of application No. 13/212,631, filed on Aug. 18, 2011, which is a continuation-in-part of application No. 13/290,735, filed on Nov. 7, 2011.

(60) Provisional application No. 61/417,789, filed on Nov. 29, 2010.

(51) Int. Cl.
*F01K 23/04* (2006.01)
*F01K 25/02* (2006.01)
*F01K 25/08* (2006.01)

(52) U.S. Cl.
CPC ..... *F01K 25/08* (2013.01)
USPC ..... 60/655; 60/684

(58) Field of Classification Search
USPC ..... 60/655, 650, 670, 682, 684
See application file for complete search history.

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |
| 2,691,280 | A | 10/1954 | Albert |
| 3,095,274 | A | 6/1963 | Crawford |
| 3,105,748 | A | 10/1963 | Stahl |

(Continued)

FOREIGN PATENT DOCUMENTS

| | | | |
|---|---|---|---|
| CA | 2794150 | A1 | 11/2011 |
| CN | 1165238 | A | 11/1997 |

(Continued)

OTHER PUBLICATIONS

PCT/US2011/029486—International Search Report and Written Opinion dated Nov. 16, 2011.

(Continued)

*Primary Examiner* — Hoang Nguyen

(57) ABSTRACT

A system for converting thermal energy to work. The system includes a working fluid circuit, and a precooler configured to receive the working fluid. The system also includes a compression stages and intercoolers. At least one of the precooler and the intercoolers is configured to receive a heat transfer medium from a high temperature ambient environment. The system also includes heat exchangers coupled to a source of heat and being configured to receive the working fluid. The system also includes turbines coupled to one or more of the heat exchangers and configured to receive heated working fluid therefrom. The system further includes recuperators fluidly coupled to the turbines, the precooler, the compressor, and at least one of the heat exchangers. The recuperators transfer heat from the working fluid downstream from the turbines, to the working fluid upstream from at least one of the heat exchangers.

21 Claims, 8 Drawing Sheets

(56) References Cited

U.S. PATENT DOCUMENTS 3,237,403 A 3/1966 Feher
3,277,955 A 10/1966 Heller
3,401,277 A 9/1968 Larson
3,622,767 A 11/1971 Koepcke
3,630,022 A * 12/1971 Jubb ..... 376/391
3,736,745 A 6/1973 Karig
3,772,879 A 11/1973 Engdahl
3,791,137 A 2/1974 Jubb
3,830,062 A 8/1974 Morgan et al.
3,939,328 A 2/1976 Davis
3,971,211 A 7/1976 Wethe
3,982,379 A 9/1976 Gilli
3,998,058 A 12/1976 Park
4,009,575 A 3/1977 Hartman, Jr.
4,029,255 A 6/1977 Heiser
4,030,312 A 6/1977 Wallin
4,049,407 A 9/1977 Bottum
4,070,870 A 1/1978 Bahel
4,099,381 A 7/1978 Rappoport
4,119,140 A 10/1978 Cates
4,150,547 A * 4/1979 Hobson ..... 60/659
4,152,901 A 5/1979 Munters
4,164,848 A 8/1979 Gilli
4,164,849 A 8/1979 Mangus
4,170,435 A 10/1979 Swearingen
4,182,960 A 1/1980 Reuyl
4,183,220 A 1/1980 Shaw
4,198,827 A 4/1980 Terry et al.
4,208,882 A 6/1980 Lopes
4,221,185 A 9/1980 Scholes
4,233,085 A 11/1980 Roderick
4,236,869 A 12/1980 Luarello
4,248,049 A 2/1981 Briley
4,257,232 A 3/1981 Bell
4,287,430 A 9/1981 Guido
4,336,692 A 6/1982 Ecker
4,347,711 A 9/1982 Noe
4,347,714 A 9/1982 Kinsell
4,372,125 A 2/1983 Dickenson
4,384,568 A 5/1983 Palmatier
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,448,033 A 5/1984 Briccetti
4,450,363 A 5/1984 Russell
4,455,836 A 6/1984 Binstock
4,467,609 A 8/1984 Loomis
4,467,621 A 8/1984 O'Brien
4,475,353 A 10/1984 Lazare
4,489,562 A 12/1984 Snyder
4,489,563 A 12/1984 Kalina
4,498,289 A 2/1985 Osgerby
4,516,403 A 5/1985 Tanaka
4,538,960 A 9/1985 Iino et al.
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger
4,589,255 A 5/1986 Martens
4,636,578 A 1/1987 Feinberg
4,674,297 A 6/1987 Vobach
4,694,189 A 9/1987 Haraguchi
4,697,981 A 10/1987 Brown et al.
4,700,543 A 10/1987 Krieger
4,730,977 A 3/1988 Haaser
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,867,633 A 9/1989 Gravelle
4,892,459 A 1/1990 Guelich
4,986,071 A 1/1991 Voss
4,993,483 A 2/1991 Harris
5,000,003 A 3/1991 Wicks
5,050,375 A 9/1991 Dickinson
5,083,425 A * 1/1992 Hendriks et al. ..... 60/39.183
5,098,194 A 3/1992 Kuo
5,102,295 A 4/1992 Pope
5,104,284 A 4/1992 Hustak, Jr.
5,164,020 A 11/1992 Wagner
5,176,321 A 1/1993 Doherty
5,203,159 A 4/1993 Koizumi
5,228,310 A 7/1993 Vandenberg
5,291,960 A 3/1994 Brandenburg
5,320,482 A 6/1994 Palmer et al.
5,335,510 A 8/1994 Rockenfeller
5,358,378 A 10/1994 Holscher
5,360,057 A 11/1994 Rockenfeller
5,392,606 A 2/1995 Labinov
5,440,882 A 8/1995 Kalina
5,444,972 A 8/1995 Moore
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,570,578 A 11/1996 Saujet
5,588,298 A 12/1996 Kalina
5,600,967 A 2/1997 Meckler
5,634,340 A * 6/1997 Grennan ..... 60/652
5,647,221 A 7/1997 Garris, Jr.
5,649,426 A 7/1997 Kalina
5,676,382 A 10/1997 Dahlheimer
5,680,753 A 10/1997 Hollinger
5,738,164 A 4/1998 Hildebrand
5,754,613 A 5/1998 Hashiguchi
5,771,700 A 6/1998 Cochran
5,789,822 A 8/1998 Calistrat
5,813,215 A 9/1998 Weisser
5,833,876 A 11/1998 Schnur
5,862,666 A 1/1999 Liu
5,873,260 A 2/1999 Linhardt
5,874,039 A 2/1999 Edelson
5,894,836 A 4/1999 Wu
5,899,067 A 5/1999 Hageman
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,973,050 A 10/1999 Johnson
6,037,683 A 3/2000 Lulay
6,041,604 A 3/2000 Nicodemus
6,058,930 A 5/2000 Shingleton
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,129,507 A 10/2000 Ganelin
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,282,900 B1 9/2001 Bell
6,282,917 B1 9/2001 Mongan
6,295,818 B1 10/2001 Ansley
6,299,690 B1 10/2001 Mongeon
6,341,781 B1 1/2002 Matz
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda

(56) References Cited

U.S. PATENT DOCUMENTS 6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse et al.
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,533 B2 4/2006 Lewis-Aburn et al.
7,033,553 B2 4/2006 Johnston et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 * 12/2008 Althaus et al. ..... 60/646
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
2001/0015061 A1 8/2001 Viteri et al.
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin

(56) References Cited

U.S. PATENT DOCUMENTS

| | | | |
|---|---|---|---|
| 2007/0108200 | A1 | 5/2007 | McKinzie, II |
| 2007/0119175 | A1 | 5/2007 | Ruggieri et al. |
| 2007/0130952 | A1 | 6/2007 | Copen |
| 2007/0151244 | A1 | 7/2007 | Gurin |
| 2007/0161095 | A1 | 7/2007 | Gurin |
| 2007/0163261 | A1 | 7/2007 | Strathman |
| 2007/0195152 | A1 | 8/2007 | Kawai et al. |
| 2007/0204620 | A1 | 9/2007 | Pronske et al. |
| 2007/0227472 | A1 | 10/2007 | Takeuchi et al. |
| 2007/0234722 | A1 | 10/2007 | Kalina |
| 2007/0245733 | A1 | 10/2007 | Pierson et al. |
| 2007/0246206 | A1 | 10/2007 | Gong et al. |
| 2008/0000225 | A1 | 1/2008 | Kalina |
| 2008/0006040 | A1 | 1/2008 | Peterson et al. |
| 2008/0010967 | A1 | 1/2008 | Griffin |
| 2008/0023666 | A1 | 1/2008 | Gurin |
| 2008/0053095 | A1 | 3/2008 | Kalina |
| 2008/0066470 | A1 | 3/2008 | MacKnight |
| 2008/0135253 | A1 | 6/2008 | Vinegar et al. |
| 2008/0163625 | A1 | 7/2008 | O'Brien |
| 2008/0173450 | A1 | 7/2008 | Goldberg et al. |
| 2008/0211230 | A1 | 9/2008 | Gurin |
| 2008/0250789 | A1 | 10/2008 | Myers et al. |
| 2008/0252078 | A1 | 10/2008 | Myers |
| 2009/0021251 | A1 | 1/2009 | Simon |
| 2009/0085709 | A1 | 4/2009 | Meinke |
| 2009/0107144 | A1 | 4/2009 | Moghtaderi et al. |
| 2009/0139234 | A1 | 6/2009 | Gurin |
| 2009/0139781 | A1 | 6/2009 | Straubel |
| 2009/0173337 | A1 | 7/2009 | Tamaura et al. |
| 2009/0173486 | A1 | 7/2009 | Copeland |
| 2009/0180903 | A1 | 7/2009 | Martin et al. |
| 2009/0205892 | A1 | 8/2009 | Jensen et al. |
| 2009/0211251 | A1 | 8/2009 | Petersen et al. |
| 2009/0211253 | A1 | 8/2009 | Radcliff et al. |
| 2009/0266075 | A1 | 10/2009 | Westmeier et al. |
| 2009/0293503 | A1 | 12/2009 | Vandor |
| 2010/0024421 | A1 | 2/2010 | Litwin |
| 2010/0077792 | A1 | 4/2010 | Gurin |
| 2010/0083662 | A1 | 4/2010 | Kalina |
| 2010/0102008 | A1 | 4/2010 | Hedberg |
| 2010/0122533 | A1 | 5/2010 | Kalina |
| 2010/0146949 | A1 | 6/2010 | Stobart et al. |
| 2010/0146973 | A1 | 6/2010 | Kalina |
| 2010/0156112 | A1 | 6/2010 | Held et al. |
| 2010/0162721 | A1 | 7/2010 | Welch et al. |
| 2010/0205962 | A1 | 8/2010 | Kalina |
| 2010/0218513 | A1 | 9/2010 | Vaisman et al. |
| 2010/0218930 | A1 | 9/2010 | Proeschel |
| 2010/0263380 | A1 | 10/2010 | Biederman et al. |
| 2010/0287934 | A1 | 11/2010 | Glynn et al. |
| 2010/0300093 | A1 | 12/2010 | Doty |
| 2010/0326076 | A1 | 12/2010 | Ast et al. |
| 2011/0027064 | A1 | 2/2011 | Pal et al. |
| 2011/0030404 | A1 | 2/2011 | Gurin |
| 2011/0048012 | A1 | 3/2011 | Ernst et al. |
| 2011/0061384 | A1 | 3/2011 | Held et al. |
| 2011/0061387 | A1 | 3/2011 | Held et al. |
| 2011/0088399 | A1 | 4/2011 | Briesch et al. |
| 2011/0179799 | A1 | 7/2011 | Allam |
| 2011/0185729 | A1 | 8/2011 | Held |
| 2011/0192163 | A1 | 8/2011 | Kasuya |
| 2011/0203278 | A1 | 8/2011 | Kopecek et al. |
| 2011/0259010 | A1 | 10/2011 | Bronicki et al. |
| 2011/0299972 | A1 | 12/2011 | Morris et al. |
| 2011/0308253 | A1 | 12/2011 | Ritter |
| 2012/0047892 | A1 | 3/2012 | Held et al. |
| 2012/0067055 | A1 | 3/2012 | Held |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0159922 | A1 | 6/2012 | Gurin |
| 2012/0159956 | A1 | 6/2012 | Gurin |
| 2012/0174558 | A1 | 7/2012 | Gurin |
| 2012/0186219 | A1 | 7/2012 | Gurin |
| 2012/0247134 | A1 | 10/2012 | Gurin |
| 2012/0247455 | A1 | 10/2012 | Gurin et al. |
| 2012/0261090 | A1 | 10/2012 | Durmaz et al. |
| 2013/0019597 | A1 | 1/2013 | Kalina |
| 2013/0033037 | A1 | 2/2013 | Held et al. |
| 2013/0036736 | A1 | 2/2013 | Hart et al. |
| 2013/0113221 | A1 | 5/2013 | Held |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| EP | 1977174 | A2 | 10/2008 |
| EP | 1998013 | A2 | 12/2008 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | | 1/2013 |
| GB | 856985 | A | 12/1960 |
| GB | 2010974 | A | 7/1979 |
| GB | 2075608 | A | 11/1981 |
| JP | 58-193051 | A | 11/1983 |
| JP | 60040707 | A | 3/1985 |
| JP | 61-152914 | A | 7/1986 |
| JP | 01-240705 | A | 9/1989 |
| JP | 05-321612 | A | 12/1993 |
| JP | 06-331225 | A | 11/1994 |
| JP | 08028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11270352 | | 5/1999 |
| JP | 2000257407 | A | 9/2000 |
| JP | 2001-193419 | A | 7/2001 |
| JP | 2002-097965 | A | 4/2002 |
| JP | 2003529715 | A | 10/2003 |
| JP | 2004-239250 | A | 8/2004 |
| JP | 2004-332626 | A | 11/2004 |
| JP | 2005030727 | A | 2/2005 |
| JP | 2005-533972 | | 11/2005 |
| JP | 2005-533972 | A1 | 11/2005 |
| JP | 2006037760 | A | 2/2006 |
| JP | 2006177266 | A | 7/2006 |
| JP | 2007-198200 | | 8/2007 |
| JP | 2007-198200 | A | 9/2007 |
| JP | 4343738 | B2 | 10/2009 |
| JP | 2011-017268 | A | 1/2011 |
| KR | 10-0191080 | B1 | 6/1999 |
| KR | 100191080 | | 6/1999 |
| KR | 10 2007 0086244 | A | 8/2007 |
| KR | 10-0766101 | B1 | 10/2007 |
| KR | 10-0844634 | A | 7/2008 |
| KR | 10-0844634 | B1 | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 91/05145 | A1 | 4/1991 |
| WO | WO 96/09500 | A1 | 3/1996 |
| WO | 0071944 | A1 | 11/2000 |
| WO | WO 01/44658 | A1 | 6/2001 |
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |

(56) References Cited

FOREIGN PATENT DOCUMENTS

| | | | |
|---|---|---|---|
| WO | WO 2007/082103 | A2 | 7/2007 |
| WO | WO 2007/112090 | A2 | 10/2007 |
| WO | WO 2008/039725 | A2 | 4/2008 |
| WO | 2008101711 | A2 | 8/2008 |
| WO | 2009-045196 | A1 | 4/2009 |
| WO | WO 2009/058992 | A2 | 5/2009 |
| WO | 2010-074173 | A1 | 7/2010 |
| WO | 2010083198 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | 2012-074905 | A2 | 6/2012 |
| WO | 2012-074907 | A2 | 6/2012 |
| WO | 2012-074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |

OTHER PUBLICATIONS

PCT/US2011/062201—International Search Report and Written Opinion dated Jun. 26, 2012.

PCT/US2011/062207—International Search Report and Written Opinion dated Jun. 28, 2012.

PCT/US2011/062198—International Search Report and Written Opinion dated Jul. 2, 2012.

PCT/US2011/062266—International Search Report and Written Opinion dated Jul. 9, 2012.

PCT/US2011/029486—International Preliminary Report on Patentability dated Sep. 25, 2012.

PCT/US2012/062204—International Search Report and Written Opinion dated Nov. 1, 2012.

Vaclav Dostal, Martin Kulhanek, "Research on the Supercritical Carbon Dioxide Cycles in the Czech Republic", Department of Fluid Mechanics and Power Engineering Czech Technical University in Prague, RPI, Troy, NY, Apr. 29-30, 2009; 8 pages.

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chordia, Lalit, "Optimizing Equipment for Supercritical Applications", Thar Energy LLC, Supercritical CO2 Power Cycle Symposium, May 24-25, 2011, Boulder, CO, 7 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

Feher, E.G., et al., "Investigation of Supercritical (Feher) Cycle", Astropower Laboratory, Missile & Space Systems Division, Oct. 1968, 152 pages.

Fuller, Robert L., and Eisemann, Kevin, "Centrifugal Compressor Off-Design Performance for Super-Critical CO2" , Barber Nichols, Inc. Presentation, Supercritical CO2 Power Cycle Symposium, May 24-25, 2011, Boulder, CO, 20 pages.

Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.

Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.

Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.

Hejzlar, P. et al., "Assessment of Gas Cooled Gas Reactor with Indirect Supercritical CO2 Cycle" Massachusetts Institute of Technology, Jan. 2006, 10 pages.

Hoffman, John R., and Feher, E.G., "150 kwe Supercritical Closed Cycle System", Transactions of the ASME, Jan. 1971, pp. 70-80.

Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.

Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.

Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).

Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.

Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.

Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.

(56) References Cited

OTHER PUBLICATIONS

Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering—2007, Oct. 23-27, 2007, Hangzhou, China, pp. 86-87.
Noriega, Bahamonde J.S., "Design Method for s-CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/031614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and Written Opinion of the International Searching Authority, or the Declaration dated Sep. 1, 2010, 6 pages.
PCT/US2010/044476—International Search Report dated Sep. 29, 2010, 23 pages.
PCT/US2010/044681—International Search Report and Written Opinion mailed Oct. 7, 2010, 10 pages.
PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Tom, Samsun Kwok Sun, "The Feasibility of Using Supercritical Carbon Dioxide as a Coolant for the Candu Reactor", The University of British Columbia, Jan. 1978, 156 pages.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 pages, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.
CN Search Report for Application No. 201080035382.1, 2 pages.
CN Search Report for Application No. 201080050795.7, 2 pages.
PCT/US2011/062198—Extended European Search Report dated May 6, 2014, 9 pages.
PCT/US2011/062201—Extended European Search Report dated May 28, 2014, 8 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.

(56) References Cited

OTHER PUBLICATIONS

PCT/US2014/013154—International Search Report dated May 23, 2014, 4 pages.
PCT/US2014/013170—Notification of Transmittal of the International Search Report and the Written Opinion of the International Searching Authority, or the Declaration dated May 9, 2014, 12 pages.
PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.

* cited by examiner

HEAT ENGINE CYCLES FOR HIGH AMBIENT CONDITIONS

CROSS-REFERENCE TO RELATED APPLICATIONS

This application is a continuation-in-part of U.S. patent application Ser. No. 13/212,631, filed Aug. 18, 2011, which claims priority to U.S. Provisional Patent Application Ser. No. 61/417,789, filed Nov. 29, 2010. This application is also a continuation-in-part of U.S. patent application Ser. No. 13/290,735, filed Nov. 7, 2011. These priority applications are incorporated by reference herein in their entirety.

BACKGROUND

Heat is often created as a byproduct of industrial processes where flowing streams of liquids, solids, or gasses that contain heat must be exhausted into the environment or otherwise removed from the process in an effort to maintain the operating temperatures of the industrial process equipment. Sometimes the industrial process can use heat exchanging devices to capture the heat and recycle it back into the process via other process streams. Other times it is not feasible to capture and recycle this heat because it is either too low in temperature or there is no readily available means to use as heat directly. This type of heat is generally referred to as "waste" heat, and is typically discharged directly into the environment through, for example, a stack, or indirectly through a cooling medium, such as water. In other settings, such heat is readily available from renewable sources of thermal energy, such as heat from the sun (which may be concentrated or otherwise manipulated) or geothermal sources. These and other thermal energy sources are intended to fall within the definition of "waste heat," as that term is used herein.

Waste heat can be utilized by turbine generator systems which employ thermodynamic methods, such as the Rankine cycle, to convert heat into work. Supercritical $CO_2$ thermodynamic power cycles have been proposed, which may be applied where more conventional working fluids are not well-suited. The supercritical state of the $CO_2$ provides improved thermal coupling with multiple heat sources. For example, by using a supercritical fluid, the temperature glide of a process heat exchanger can be more readily matched. However, single-cycle, supercritical $CO_2$ power cycles operate over a limited pressure ratio, thereby limiting the amount of temperature reduction, i.e., energy extraction, through the power conversion device (typically a turbine or positive displacement expander). The pressure ratio is limited primarily due to the high vapor pressure of the fluid at typically available condensation temperatures (e.g., ambient). As a result, the maximum output power that can be achieved from a single expansion stage is limited, and the expanded fluid retains a significant amount of potentially usable energy. While a portion of this residual energy can be recovered within the cycle by using a heat exchanger as a recuperator, and thus preheating the fluid between the pump and waste heat exchanger, this approach limits the amount of heat that can be extracted from the waste heat source in a single cycle.

One way to maximize the pressure ratio, and thus increase power extraction and efficiency, is to manipulate the temperature of the working fluid in the thermodynamic cycle, especially at the suction inlet of the cycle pump (or compressor). Heat exchangers, such as condensers, are typically used for this purpose, but conventional condensers are directly limited by the temperature of the cooling medium being circulated therein, which is frequently ambient air or water. On hot days, the temperature of such cooling media is heightened, which can reduce efficiency and can be especially problematic in $CO_2$-based thermodynamic cycles or other thermodynamic cycles employing a working fluid with a critical temperature that is lower than the relatively high ambient temperature. As a result, the condenser has difficulty condensing the working fluid and cycle efficiency suffers.

Accordingly, there exists a need in the art for a system that can efficiently and effectively produce power from waste heat or other thermal sources and operates efficiently in high-ambient temperature environments.

SUMMARY

Embodiments of the disclosure may provide an exemplary system for converting thermal energy to work in high ambient temperature conditions. The system includes first and second compression stages fluidly coupled together such that the first compression stage is upstream of the second compressor stage. The first and second compression stages are configured to compress a working fluid in a working fluid circuit. The working fluid is separated into a first mass flow and a second mass flow downstream from the second compression stage. The system also includes an intercooler disposed upstream from the second compression stage and downstream from the first compression stage, and first and second heat exchangers coupled to a source of heat and disposed downstream from the second compression stage. The first heat exchanger is configured to transfer heat from the source of heat to the first mass flow and the second heat exchanger is configured to transfer heat from the source of heat to the second mass flow. The system also includes first and second turbines. The first turbine is configured to receive the first mass flow from the first heat exchanger and the second turbine is configured to receive the second mass flow from the second heat exchanger. The system further includes a first recuperator disposed downstream from the first turbine on a high temperature side of the working fluid circuit and between the second compression stage and the second turbine on a low temperature side of the working fluid circuit. The first recuperator is configured to transfer heat from the working fluid on the high temperature side to working fluid on the low temperature side. The system further includes a second recuperator disposed downstream from the second turbine on the high temperature side and between the second compression stage and the second turbine on the low temperature side. The second recuperator is configured to transfer heat from the working fluid on the high temperature side to working fluid on the low temperature side.

Embodiments of the disclosure may also provide an exemplary system for converting thermal energy to work. The system includes a plurality of compression stages fluidly coupled together in series and configured to compress and circulate a working fluid in a working fluid circuit. The system also includes one or more intercoolers, each being disposed between two of the plurality of compression stages and configured to cool the working fluid, at least one of the one or more intercoolers being configured to receive a heat transfer medium from an ambient environment, with the ambient environment having a temperature of between about 30° C. and about 50° C. The system further includes first and second heat exchangers fluidly coupled in series to a source of heat and fluidly coupled to the working fluid circuit. The first heat exchanger is configured to receive a first mass flow of the working fluid and second heat exchanger configured to receive a second mass flow of the working fluid. The system also includes a first turbine configured to receive the first mass flow of working fluid from the first heat exchanger. The system also includes a second turbine configured to receive the second mass flow of working fluid from the second heat exchanger. The system further includes a plurality of recuperators, with the plurality of recuperators being configured to transfer heat from the first mass flow downstream from the first turbine to working fluid upstream from the first heat exchanger, and configured to transfer heat from at least the second mass flow downstream from the second turbine to at least the second mass flow upstream from the second heat exchanger.

A system for converting thermal energy to work in a high ambient temperature environment. The system includes a working fluid circuit having a high temperature side and a low temperature side, with the working fluid circuit containing a working fluid comprising carbon dioxide. The system further includes a precooler configured to receive the working fluid from the high temperature side. The system also includes a compressor having a plurality of stages and one or more intercoolers configured to cool the working fluid between at least two of the plurality of stages. The compressor is configured to receive the working fluid from the precooler. At least one of the precooler and the one or more intercoolers is configured to receive a heat transfer medium from the ambient environment, the ambient environment having a temperature of between about 30° C. and about 50° C. The system also includes a plurality of heat exchangers coupled to a source of heat, with the plurality of heat exchangers being configured to receive fluid from the low temperature side and discharge fluid to the high temperature side. The system also includes a plurality of turbines disposed on the high temperature side of the working fluid circuit, each of the plurality of turbines being coupled to one or more of the plurality of heat exchangers and configured to receive heated working fluid therefrom. The system further includes a plurality of recuperators, each being coupled the high and low temperature sides of the working fluid circuit. The plurality of recuperators are coupled, on the high temperature side, to at least one of the plurality of turbines and to the precooler and, on the low temperature side, to the compressor and at least one of the plurality of heat exchangers. The plurality of recuperators are configured to transfer heat from the working fluid in the high temperature side, downstream from at least one of the plurality of turbines, to the working fluid on the low temperature side upstream from at least one of the plurality of heat exchangers.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
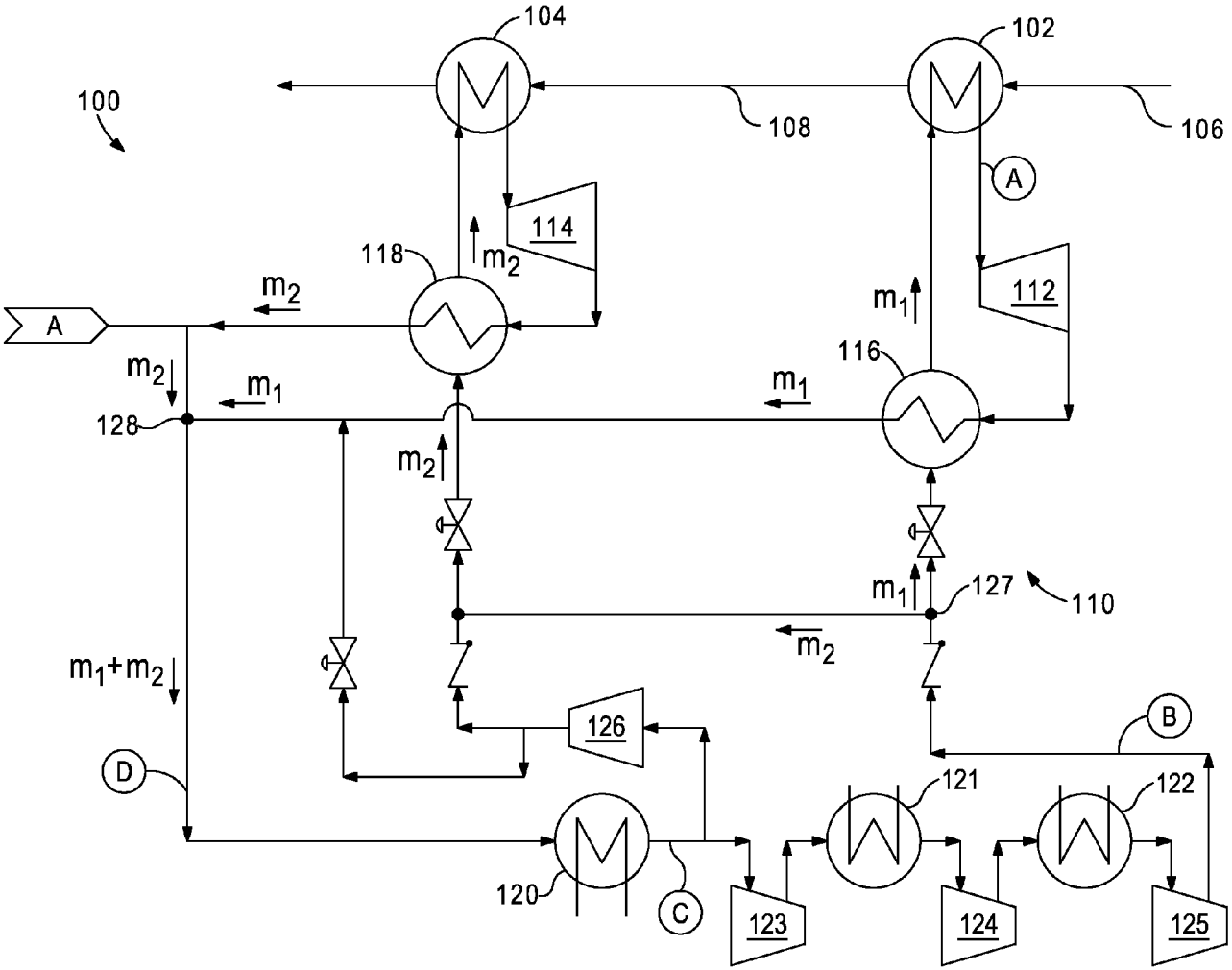
FIG. 1 schematically illustrates an exemplary embodiment of a heat engine cycle, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary thermodynamic cycle 100, according to one or more embodiments of the disclosure that may be used to convert thermal energy to work by thermal expansion of a working fluid. The cycle 100 is characterized as a Rankine cycle and may be implemented in a heat engine device that includes multiple heat exchangers in fluid communication with a waste heat source, multiple turbines for power generation and/or pump driving power, and multiple recuperators located downstream of the turbine(s).

Specifically, the thermodynamic cycle 100 may include a working fluid circuit 110 in thermal communication with a heat source 106 via a first heat exchanger 102, and a second heat exchanger 104 arranged in series. It will be appreciated that any number of heat exchangers may be utilized in conjunction with one or more heat sources. In one exemplary embodiment, the first and second heat exchangers 102, 104 may be waste heat exchangers. In other exemplary embodiments, the first and second heat exchangers 102, 104 may include first and second stages, respectively, of a single or combined waste heat exchanger.

The heat source 106 may derive thermal energy from a variety of high temperature sources. For example, the heat source 106 may be a waste heat stream such as, but not limited to, gas turbine exhaust, process stream exhaust, or other combustion product exhaust streams, such as furnace or boiler exhaust streams. Accordingly, the thermodynamic cycle 100 may be configured to transform waste heat into electricity for applications ranging from bottom cycling in gas turbines, stationary diesel engine gensets, industrial waste heat recovery (e.g., in refineries and compression stations), and hybrid alternatives to the internal combustion engine. In other exemplary embodiments, the heat source 106 may derive thermal energy from renewable sources of thermal energy such as, but not limited to, solar thermal and geothermal sources.

While the heat source 106 may be a fluid stream of the high temperature source itself, in other exemplary embodiments the heat source 106 may be a thermal fluid in contact with the high temperature source. The thermal fluid may deliver the thermal energy to the waste heat exchangers 102, 104 to transfer the energy to the working fluid in the circuit 100.

As illustrated, the first heat exchanger 102 may serve as a high temperature, or relatively higher temperature, heat exchanger adapted to receive an initial or primary flow of the heat source 106. In various exemplary embodiments of the disclosure, the initial temperature of the heat source 106 entering the cycle 100 may range from about 400° F. to greater than about 1,200° F. (about 204° C. to greater than about 650° C.). In the illustrated exemplary embodiment, the initial flow of the heat source 106 may have a temperature of about 500° C. or higher. The second heat exchanger 104 may then receive the heat source 106 via a serial connection 108 downstream from the first heat exchanger 102. In one exemplary embodiment, the temperature of the heat source 106 provided to the second heat exchanger 104 may be about 250-300° C. It should be noted that representative operative temperatures, pressures, and flow rates as indicated in the Figures are by way of example and are not in any way to be considered as limiting the scope of the disclosure.

As can be appreciated, a greater amount of thermal energy is transferred from the heat source 106 via the serial arrangement of the first and second heat exchangers 102, 104, whereby the first heat exchanger 102 transfers heat at a relatively higher temperature spectrum in the waste heat stream 106 than the second heat exchanger 104. Consequently, greater power generation results from the associated turbines or expansion devices, as will be described in more detail below.

The working fluid circulated in the working fluid circuit 110, and the other exemplary circuits disclosed herein below, may be carbon dioxide ($CO_2$). Carbon dioxide as a working fluid for power generating cycles has many advantages. It is a greenhouse friendly and neutral working fluid that offers benefits such as non-toxicity, non-flammability, easy availability, low price, and no need of recycling. Due in part to its relative high working pressure, a $CO_2$ system can be built that is much more compact than systems using other working fluids. The high density and volumetric heat capacity of $CO_2$ with respect to other working fluids makes it more "energy dense" meaning that the size of all system components can be considerably reduced without losing performance. It should be noted that the use of the term "carbon dioxide" as used herein is not intended to be limited to a $CO_2$ of any particular type, purity, or grade. For example, in at least one exemplary embodiment industrial grade $CO_2$ may be used, without departing from the scope of the disclosure.

In other exemplary embodiments, the working fluid in the circuit 110 may be a binary, ternary, or other working fluid blend. The working fluid blend or combination can be selected for the unique attributes possessed by the fluid combination within a heat recovery system, as described herein. For example, one such fluid combination includes a liquid absorbent and $CO_2$ mixture enabling the combined fluid to be pumped in a liquid state to high pressure with less energy input than required to compress $CO_2$. In another exemplary embodiment, the working fluid may be a combination of $CO_2$ or supercritical carbon dioxide ($ScCO_2$) and one or more other miscible fluids or chemical compounds. In yet other exemplary embodiments, the working fluid may be a combination of $CO_2$ and propane, or $CO_2$ and ammonia, without departing from the scope of the disclosure.

Use of the term "working fluid" is not intended to limit the state or phase of matter that the working fluid is in. In other words, the working fluid may be in a fluid phase, a gas phase, a supercritical phase, a subcritical state, or any other phase or state at any one or more points within the fluid cycle. The working fluid may be in a supercritical state over certain portions of the circuit 110 (the "high pressure side"), and in a subcritical state over other portions of the circuit 110 (the "low pressure side"). In other exemplary embodiments, the entire working fluid circuit 110 may be operated and controlled such that the working fluid is in a supercritical or subcritical state during the entire execution of the circuit 110.

The heat exchangers 102, 104 are arranged in series in the heat source 106, but arranged in parallel in the working fluid circuit 110. The first heat exchanger 102 may be fluidly coupled to a first turbine 112, and the second heat exchanger 104 may be fluidly coupled to a second turbine 114. In turn, the first turbine 112 may be fluidly coupled to a first recuperator 116, and the second turbine 114 may be fluidly coupled to a second recuperator 118. One or both of the turbines 112, 114 may be a power turbine configured to provide electrical power to auxiliary systems or processes. The recuperators 116, 118 may be arranged in series on a low temperature side of the circuit 110 and in parallel on a high temperature side of the circuit 110. The recuperators 116, 118 divide the circuit 110 into the high and low temperature sides. For example, the high temperature side of the circuit 110 includes the portions of the circuit 110 arranged downstream from each recuperator 116, 118 where the working fluid is directed to the heat exchangers 102, 104. The low temperature side of the circuit 110 includes the portions of the circuit downstream from each recuperator 116, 118 where the working fluid is directed away from the heat exchangers 102, 104.

The working fluid circuit 110 includes a precooler 120, and one or more intercoolers (two are shown: 121, 122) disposed between compression stages (three are shown: 123, 124, 125). Although not shown, an aftercooler may also be included and disposed downstream of the final compression stage 125. The pre-cooler 121 and intercoolers 122, 123 are configured to cool the working fluid stagewise as the compression stages 123-125 compress and add heat to the working fluid. Stated otherwise, although the temperature of the working fluid may increase in each compression stage 123-125, the intercoolers 121, 122 more than offset this increased temperature and, as such, as the working fluid successively passes through the precooler 120 and each intercooler 121, 122, the temperature of the working fluid is decreased to a desired level. In high temperature ambient conditions, this stepwise cooling increases the maximum pressure ratio in certain high critical temperature working fluids, such as $CO_2$, resulting in greater work available for extraction from the system. Examples of such results are shown in and discussed in co-pending U.S. patent application Ser. No. 13/290,735.

For example, the temperature of the working fluid immediately upstream from the precooler 120 may be, for example, between about 70° C. and about 110° C. The temperature of the working fluid between the precooler 120 and the first compression stage 123 may be between about 30° C. and about 60° C. The temperature of the working fluid between the first compression stage 123 and the first intercooler 121 may be between about 65° C. and about 105° C. The temperature of the working fluid between the first intercooler 121 and the second compression stage 124 may be between about 30° C. and about 60° C. The temperature of the working fluid between the second compression stage 124 and the second intercooler 122 may be between about 40° C. and about 80° C. The temperature of the working fluid between the second intercooler 121 and the third compression stage 125 may be between about 30° C. and about 60° C. The temperature of the working fluid immediately downstream of the third compression stage 125 may be between about 50° C. and about 70° C.

The cooling medium used in the pre-cooler 121 and intercoolers 122, 123 may be ambient air or water originating from the same source. In other embodiments, the cooling medium for each of the precooler 120 and intercoolers 121, 122 originates from different sources or at different temperatures in order to optimize the power output from the circuit 110. In embodiments where ambient water is the cooling medium, one or more of the precooler 120 and intercoolers 121, 122 may be printed circuit heat exchangers, shell and tube heat exchangers, plate and frame heat exchangers, brazed plate heat exchangers, combinations thereof, or the like. In embodiments where ambient air is the cooling medium, one or more of the precooler 120 and intercoolers 121, 122 may be direct air-to-working fluid heat exchangers, such as fin and tube heat exchangers. In an exemplary embodiment, the ambient temperature of the environment in which the thermodynamic cycle 100 is operated may be between about 30° C. and about 50° C.

The compression stages 123-125 may be independently driven using one or more external drivers (not shown), such as an electrical motor, which may be powered by electricity generated by one or both of the turbines 112, 114. In another example, the compression stages 123-125 may be operatively coupled to one or both of the turbines 112, 114 via a common shaft (not shown) so as to be directly driven by the rotation of the turbine(s) 112 and/or 114. Other turbines (not shown), engines, or other types of drivers may also be used to drive the compression stages 123-125.

Further, it will be appreciated that additional or fewer compression stages, with or without associated intercoolers interposed therebetween, may be employed without departing from the scope of the present disclosure. Additionally, the compression stages 123-125 may be part of any type of compressor, such as a multi-stage centrifugal compressor. In at least one embodiment, each of the compression stages 123-125 may be representative of one or more impellers on a common shaft of a multi-stage, centrifugal compressor. Further, one or more of the precooler 120 and the intercoolers 121, 122 may be integrated with the compressor, for example, via an internally-cooled diaphragm. In other embodiments, any suitable design, whether integral or made of discrete components, may be employed for to provide the compressions stages 123-125, the precooler 120, the intercoolers 121, 122, and the aftercooler (not shown).

The working fluid circuit 110 may further include a secondary compressor 126 in fluid communication with the compression stages 123-125. The secondary compressor 126 may extract fluid from downstream of the precooler 120, pressurize it, and return the fluid to a point downstream from the final compression stage 125. The secondary compressor 126 may be a centrifugal compressor driven independently of the compression stages 123-125 by one or more external machines or devices, such as an electrical motor, diesel engine, gas turbine, or the like. In one exemplary embodiment, the compression stages 123-125 may be used to circulate the working fluid during normal operation of the cycle 100, while the secondary compressor 126 may be used only for starting the cycle 100. During normal operation, flow to the secondary compressor 126 may be diverted or cutoff or the secondary compressor 126 may be nominally driven at an attenuated rate. Furthermore, although shown directing fluid to the second recuperator 118, it will be appreciated that the secondary compressor 126 may also or instead direct working fluid to the first recuperator 116, e.g., during startup.

The first turbine 112 may operate at a higher relative temperature (e.g., higher turbine inlet temperature) than the second turbine 114, due to the temperature drop of the heat source 106 experienced across the first heat exchanger 102. In one or more exemplary embodiments, however, each turbine 112, 114 may be configured to operate at the same or substantially the same inlet pressure. This may be accomplished by design and control of the circuit 110 including, but not limited to, the control of the compression stages 123-125 and/or the use of the secondary compressor 126, one or more pumps (e.g., turbopumps), or any other devices, controls, and/or structures to optimize the inlet pressures of each turbine 112, 114 for corresponding inlet temperatures of the circuit 110.

In operation, the working fluid is separated at point 127 in the working fluid circuit 110 into a first mass flow $m_1$ and a second mass flow $m_2$. The first mass flow $m_1$ is directed through the first heat exchanger 102 and subsequently expanded in the first turbine 112. Following the first turbine 112, the first mass flow $m_1$ passes through the first recuperator 116 in order to transfer residual heat back to the first mass flow $m_1$ as it is directed toward the first heat exchanger 102. The second mass flow $m_2$ may be directed through the second heat exchanger 104 and subsequently expanded in the second turbine 114. Following the second turbine 114, the second mass flow $m_2$ passes through the second recuperator 118 to transfer residual heat back to the second mass flow $m_2$ as it is directed towed the second heat exchanger 104. The second mass flow $m_2$ is then re-combined with the first mass flow $m_1$ at point 128 in the working fluid circuit 110 to generate a combined mass flow $m_1+m_2$. The combined mass flow $m_1+m_2$ may be directed back to the precooler 120, the compression stages 123-125, and the intercoolers 121, 122 to commence the loop over again. In at least one embodiment, the working fluid at the inlet of the first compression stage 123 is supercritical.

As can be appreciated, each stage of heat exchange with the heat source 106 can be incorporated in the working fluid circuit 110 where it is most effectively utilized within the complete thermodynamic cycle 100. For example, by splitting the heat exchange into multiple stages, either with separate heat exchangers (e.g., first and second heat exchangers 102, 104) or a single or multiple heat exchangers with multiple stages, additional heat can be extracted from the heat source 106 for more efficient use in expansion, and primarily to obtain multiple expansions from the heat source 106.

Also, by using multiple turbines 112, 114 at similar or substantially similar pressure ratios, a larger fraction of the available heat source 106 may be efficiently utilized by using the residual heat from each turbine 112, 114 via the recuperators 116, 118 such that the residual heat is not lost or compromised. The arrangement of the recuperators 116, 118 in the working fluid circuit 110 can be optimized with the heat source 106 to maximize power output of the multiple temperature expansions in the turbines 112, 114. By selectively merging the parallel working fluid flows, the two sides of either of the recuperators 116, 118 may be balanced, for example, by matching heat capacity rates; $C=m\cdot c_p$, where C is the heat capacity rate, m is the mass flow rate of the working fluid, and $c_p$ is the constant pressure specific heat.

Figure 2:
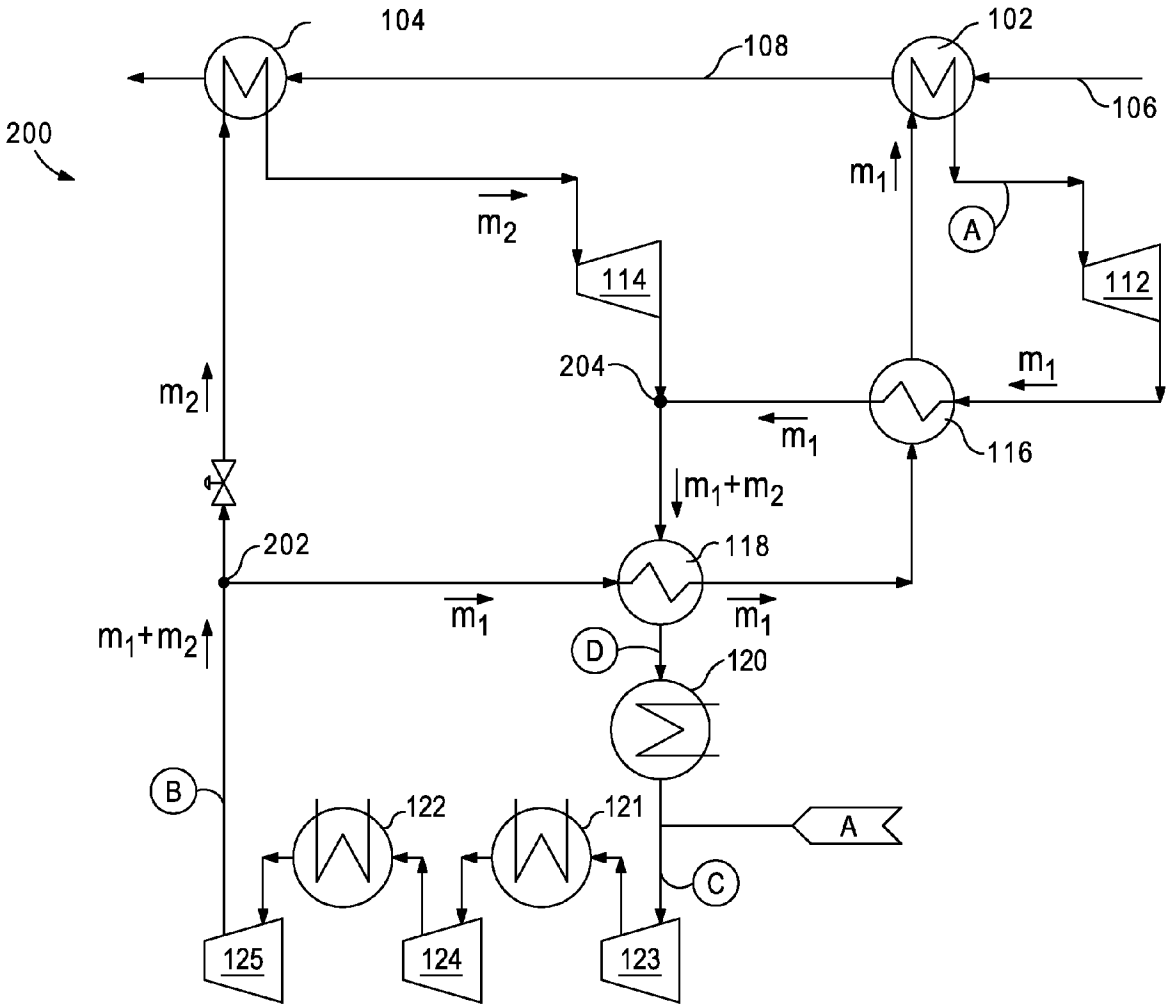
FIG. 2 schematically illustrates another exemplary embodiment of a heat engine cycle, according to one or more embodiments disclosed.

FIG. 2 illustrates another exemplary embodiment of a thermodynamic cycle 200, according to one or more embodiments disclosed. The cycle 200 may be similar in some respects to the thermodynamic cycle 100 described above with reference to FIG. 1. Accordingly, the thermodynamic cycle 200 may be best understood with reference to FIG. 1, where like numerals correspond to like elements and therefore will not be described again in detail. The cycle 200 includes first and second heat exchangers 102, 104 again arranged in series in thermal communication with the heat source 106, but in parallel in a working fluid circuit 210. The first and second recuperators 116 and 118 are arranged in series on the low temperature side of the circuit 210 and in parallel on the high temperature side of the circuit 210.

In the circuit 210, the working fluid is separated into a first mass flow $m_1$ and a second mass flow $m_2$ at a point 202. The first mass flow $m_1$ is eventually directed through the first heat exchanger 102 and subsequently expanded in the first turbine 112. The first mass flow $m_1$ then passes through the first recuperator 116 to transfer residual heat back to the first mass flow $m_1$ into the first recuperator 116. The second mass flow $m_2$ may be directed through the second heat exchanger 104 and subsequently expanded in the second turbine 114. Following the second turbine 114, the second mass flow $m_2$ is re-combined with the first mass flow $m_1$ at point 204 to generate a combined mass flow $m_1+m_2$. The combined mass flow $m_1+m_2$ may be directed through the second recuperator 118 to transfer residual heat to the first mass flow $m_1$ passing through the second recuperator 118.

The arrangement of the recuperators 116, 118 provides the combined mass flow $m_1+m_2$ to the second recuperator 118 prior to reaching the precooler 120. As can be appreciated, this may increase the thermal efficiency of the working fluid circuit 210 by providing better matching of the heat capacity rates, as defined above.

The second turbine 114 may be used to drive one or more of the compression stages 123-125. In other exemplary embodiments, however, the first turbine 112 may be used to drive one, some, or all of the compression stages 123-125, without departing from the scope of the disclosure. As will be discussed in more detail below, the first and second turbines 112, 114 may be operated at common turbine inlet pressures or different turbine inlet pressures by management of the respective mass flow rates.

Figure 3:
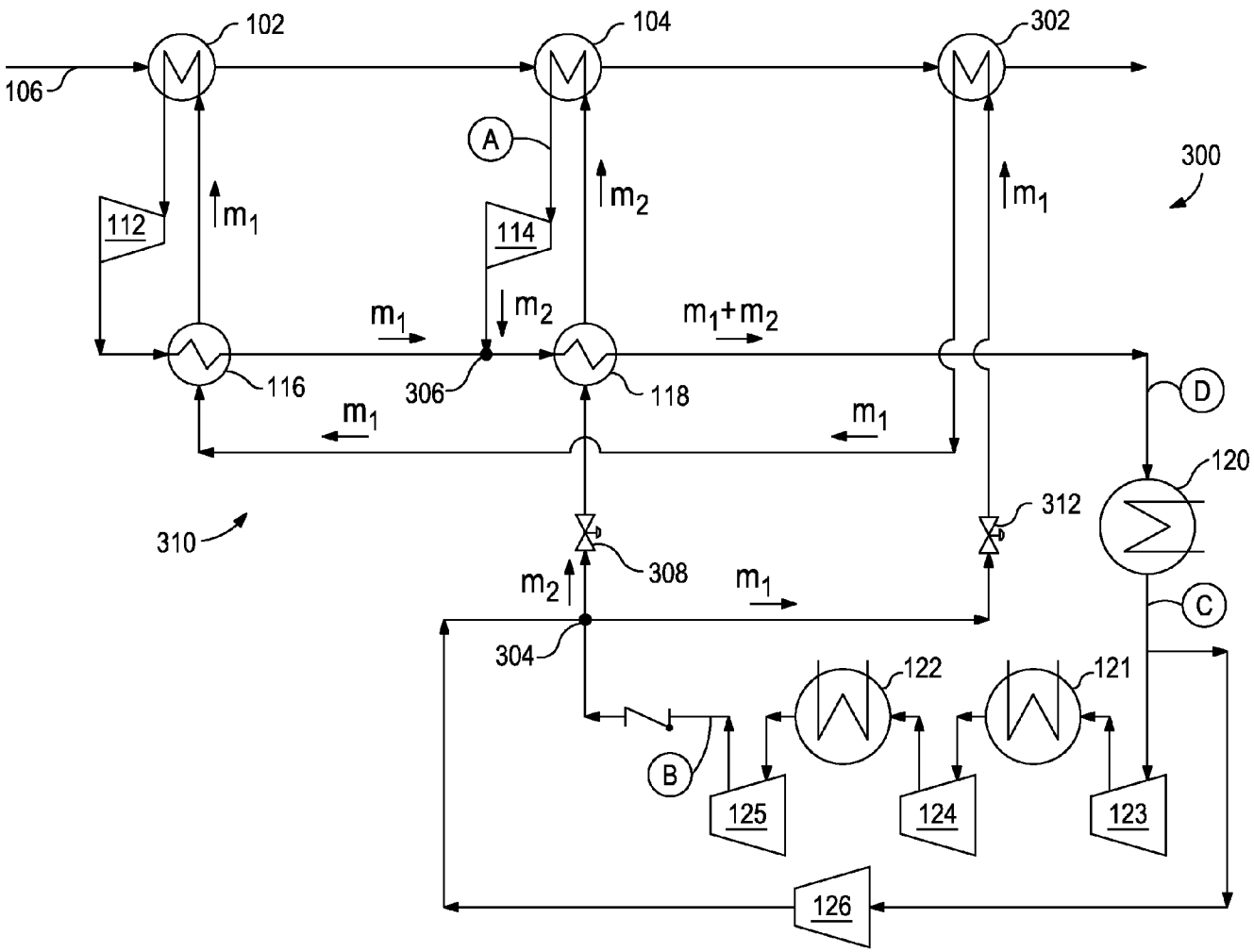
FIG. 3 schematically illustrates another exemplary embodiment of a heat engine cycle, according to one or more embodiments disclosed.

FIG. 3 illustrates another exemplary embodiment of a thermodynamic cycle 300, according to one or more embodiments of the disclosure. The cycle 300 may be similar in some respects to the thermodynamic cycles 100 and/or 200, and, as such, the cycle 300 may be best understood with reference to FIGS. 1 and 2, where like numerals correspond to like elements and therefore will not be described again in detail. The thermodynamic cycle 300 may include a working fluid circuit 310 utilizing a third heat exchanger 302 in thermal communication with the heat source 106. The third heat exchanger 302 may be a type of heat exchanger similar to the first and second heat exchanger 102, 104, as described above.

The heat exchangers 102, 104, 302 may be arranged in series in thermal communication with the heat source 106 stream, and arranged in parallel in the working fluid circuit 310. The corresponding first and second recuperators 116, 118 are arranged in series on the low temperature side of the circuit 310 with the precooler 120, and in parallel on the high temperature side of the circuit 310. After the working fluid is separated into first and second mass flows $m_1$, $m_2$ at point 304, the third heat exchanger 302 may be configured to receive the first mass flow $m_1$ and transfer heat from the heat source 106 to the first mass flow $m_1$ before reaching the first turbine 112 for expansion. Following expansion in the first turbine 112, the first mass flow $m_1$ is directed through the first recuperator 116 to transfer residual heat to the first mass flow $m_1$ discharged from the third heat exchanger 302.

The second mass flow $m_2$ is directed through the second heat exchanger 104 and subsequently expanded in the second turbine 114. Following the second turbine 114, the second mass flow $m_2$ is re-combined with the first mass flow $m_1$ at point 306 to generate the combined mass flow $m_1+m_2$ which provides residual heat to the second mass flow $m_2$ in the second recuperator 118.

The second turbine 114 again may be used to drive one or more of the compression stages 123-125 and/or one or more of the compression stages 123-125 may be otherwise driven, as described herein. The secondary or startup compressor 126 may be provided on the low temperature side of the circuit 310 and may circulate working fluid through a parallel heat exchanger path including the second and third heat exchangers 104, 302. In one exemplary embodiment, the first and third heat exchangers 102, 302 may have essentially zero flow during the startup of the cycle 300. The working fluid circuit 310 may also include a throttle valve 308 and a shutoff valve 312 to manage the flow of the working fluid. Although illustrated as being fluidly coupled to the circuit 300 between the precooler 120 and the first compression stage 123, it will be appreciated that the upstream side of the parallel heat exchanger path may be connected to the circuit 300 at any suitable location.

Figure 4:
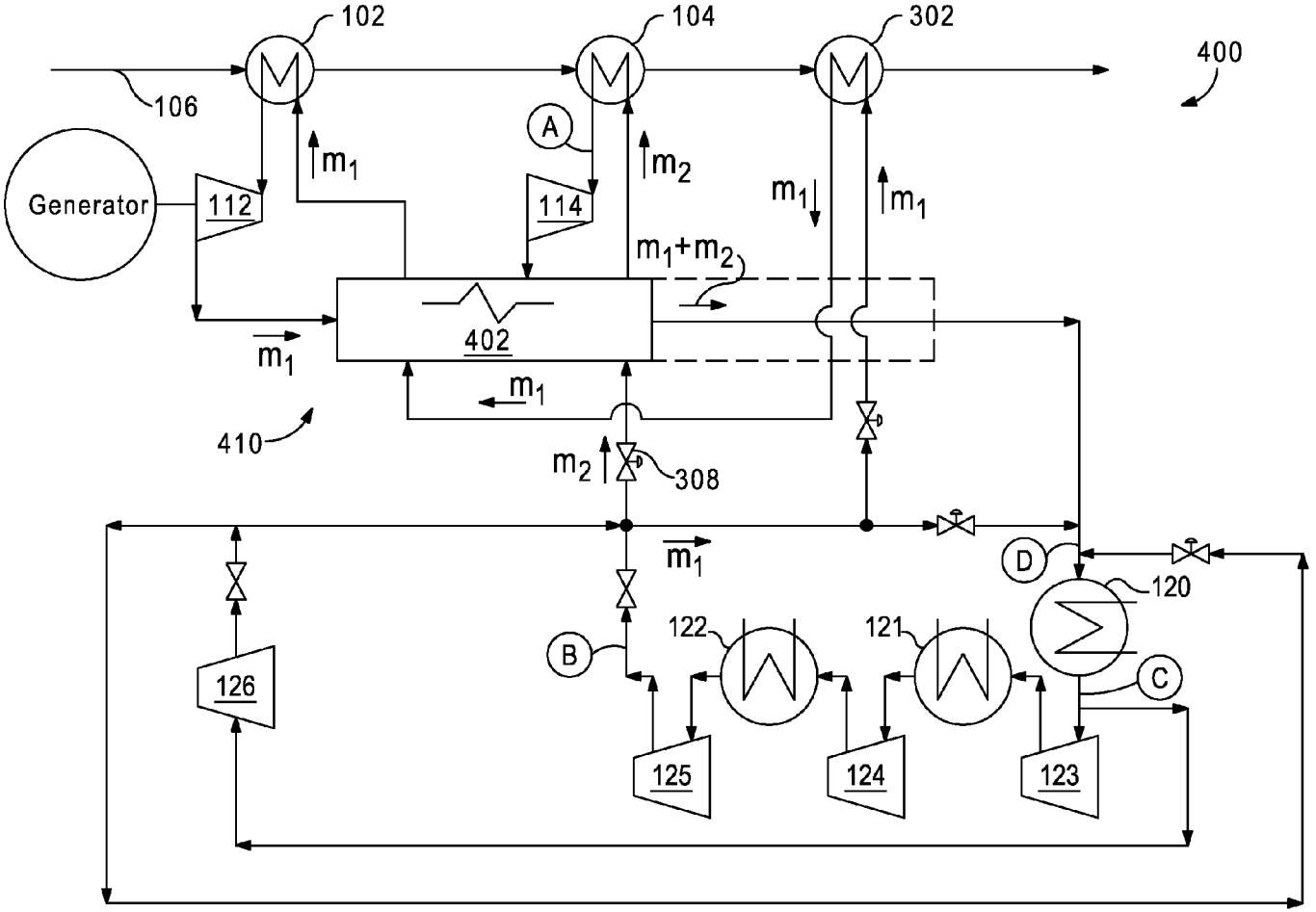
FIG. 4 schematically illustrates another exemplary embodiment of a heat engine cycle, according to one or more embodiments disclosed.

FIG. 4 illustrates another exemplary embodiment of a thermodynamic cycle 400, according to one or more exemplary embodiments disclosed. The cycle 400 may be similar in some respects to the thermodynamic cycles 100, 200, and/or 300, and as such, the cycle 400 may be best understood with reference to FIGS. 1-3, where like numerals correspond to like elements and will not be described again in detail. The thermodynamic cycle 400 may include a working fluid circuit 410 where the first and second recuperators 116, 118 are combined into or otherwise replaced with a single recuperator 402. The recuperator 402 may be of a similar type as the recuperators 116, 118 described herein, or may be another type of recuperator or heat exchanger known to those skilled in the art.

As illustrated, the recuperator 402 may be configured to transfer heat to the first mass flow $m_1$ as it enters the first heat exchanger 102 and receive heat from the first mass flow $m_1$ as it exits the first turbine 112. The recuperator 402 may also transfer heat to the second mass flow $m_2$ as it enters the second heat exchanger 104 and receive heat from the second mass flow $m_1$ as it exits the second turbine 114. The combined mass flow $m_1+m_2$ flows out of the recuperator 402 and to the precooler 120.

In other exemplary embodiments, the recuperator 402 may be enlarged, as indicated by the dashed extension lines illustrated in FIG. 4, or otherwise adapted to receive the first mass flow $m_1$ entering and exiting the third heat exchanger 302. Consequently, additional thermal energy may be extracted from the recuperator 304 and directed to the third heat exchanger 302 to increase the temperature of the first mass flow $m_1$.

Figure 5:
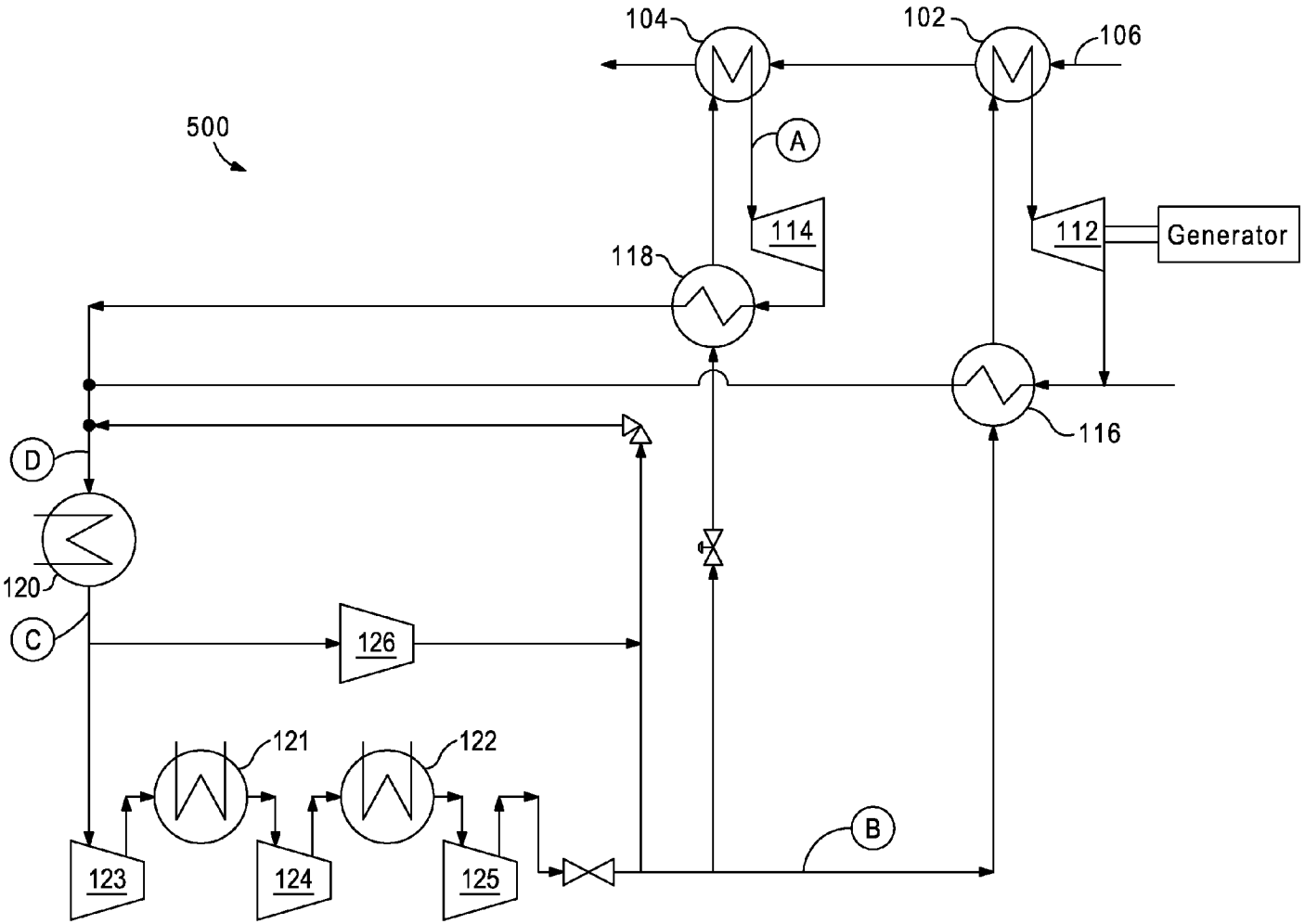
FIG. 5 schematically illustrates another exemplary embodiment of a heat engine cycle, according to one or more embodiments disclosed.

FIG. 5 illustrates another exemplary embodiment of a thermodynamic cycle 500 according to the disclosure. The cycle 500 may be similar in some respects to the thermodynamic cycle 100, and as such, may be best understood with reference to FIG. 1 above, where like numerals correspond to like elements that will not be described again. The thermodynamic cycle 500 may have a working fluid circuit 510 substantially similar to the working fluid circuit 110 of FIG. 1 but with a different arrangement of the compression stages 123-125 and the secondary compressor 126. As illustrated in FIG. 1, each of the parallel cycles may have independent compression provided (the compression stages 123-125 for the high-temperature cycle and the secondary compressor 126 for the low-temperature cycle, respectively) to supply the working fluid flow during normal operation. In contrast, the thermodynamic cycle 500 in FIG. 5 uses the compression stages 123-125, which may be driven by the second turbine 114, to provide working fluid flows for both parallel cycles. The secondary compressor 126 in FIG. 5 only operates during the startup process of the heat engine; therefore, no motor-driven compressor (i.e., the secondary compressor 126) is required during normal operation.

Figure 6:
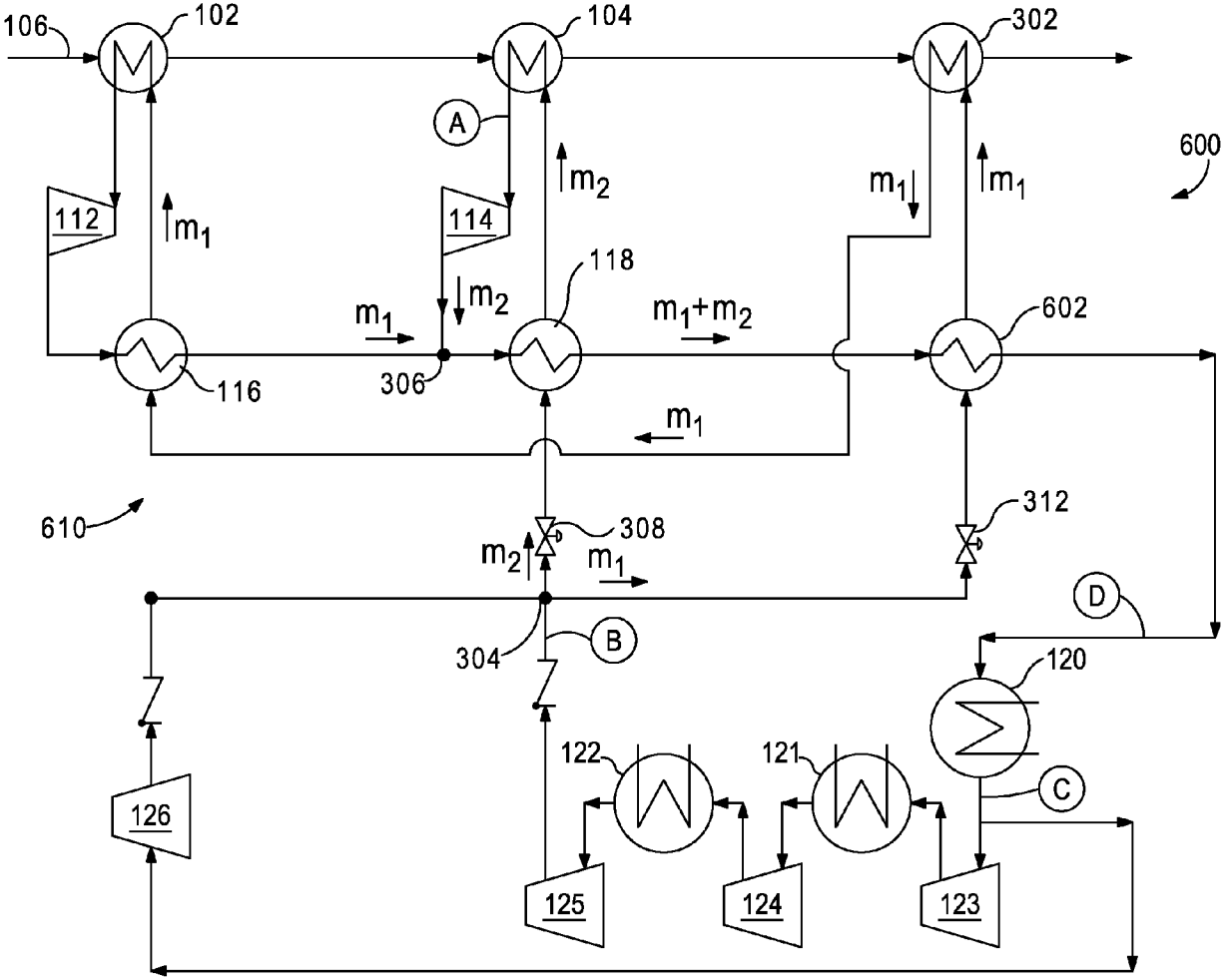
FIG. 6 schematically illustrates another exemplary embodiment of a heat engine cycle, according to one or more embodiments disclosed.

FIG. 6 illustrates another exemplary embodiment of a thermodynamic cycle 600. The cycle 600 may be similar in some respects to the thermodynamic cycle 300, and as such, may be best understood with reference to FIG. 3 above, where like numerals correspond to like elements and will not be described again in detail. The thermodynamic cycle 600 may have a working fluid circuit 610 substantially similar to the working fluid circuit 310 of FIG. 3 but with the addition of a third recuperator 602 which extracts additional thermal energy from the combined mass flow $m_1+m_2$ discharged from the second recuperator 118. Accordingly, the temperature of the first mass flow $m_1$ entering the third heat exchanger 302 may be increased prior to receiving residual heat transferred from the heat source 106.

As illustrated, the recuperators 116, 118, 602 may operate as separate heat exchanging devices. In other exemplary embodiments, however, the recuperators 116, 118, 602 may be combined into a single recuperator, similar to the recuperator 406 described above in reference to FIG. 4.

As illustrated by each exemplary thermodynamic cycle 100-600 described herein (meaning cycles 100, 200, 300, 400, 500, and 600), the parallel heat exchanging cycle and arrangement incorporated into each working fluid circuit 110-610 (meaning circuits 110, 210, 310, 410, 510, and 610) enables more power generation from a given heat source 106 by raising the power turbine inlet temperature to levels unattainable in a single cycle, thereby resulting in higher thermal efficiency for each exemplary cycle 100-600. The addition of lower temperature heat exchanging cycles via the second and third heat exchangers 104, 302 enables recovery of a higher fraction of available energy from the heat source 106. Moreover, the pressure ratios for each individual heat exchanging cycle can be optimized for additional improvement in thermal efficiency.

Other variations which may be implemented in any of the disclosed exemplary embodiments include, without limitation, the use of various arrangements of compression stages, compressors, pumps, or combinations thereof to optimize the inlet pressures for the turbines 112, 114 for any particular corresponding inlet temperature of either turbine 112, 114. In other exemplary embodiments, the turbines 112, 114 may be coupled together such as by the use of additional turbine stages in parallel on a shared power turbine shaft. Other variations contemplated herein are, but not limited to, the use of additional turbine stages in parallel on a turbine-driven pump shaft; coupling of turbines through a gear box; the use of different recuperator arrangements to optimize overall efficiency; and the use of reciprocating expanders and pumps in place of turbomachinery. It is also possible to connect the output of the second turbine 114 with the generator or electricity-producing device being driven by the first turbine 112, or even to integrate the first and second turbines 112, 114 into a single piece of turbomachinery, such as a multiple-stage turbine using separate blades/disks on a common shaft, or as separate stages of a radial turbine driving a bull gear using separate pinions for each radial turbine. Yet other exemplary variations are contemplated where the first and/or second turbines 112, 114 are coupled to one or more of the compression stages 123-125 and a motor-generator (not shown) that serves as both a starter motor and a generator.

Each of the described cycles 100-600 may be implemented in a variety of physical embodiments, including but not limited to fixed or integrated installations, or as a self-contained device such as a portable waste heat engine or "skid." The exemplary waste heat engine skid may arrange each working fluid circuit 110-610 and related components such as turbines 112, 114, recuperators 116, 118, precoolers 120, intercoolers 121, 122, compression stages 123-125, secondary compressors 126, valves, working fluid supply and control systems and mechanical and electronic controls are consolidated as a single unit. An exemplary waste heat engine skid is described and illustrated in co-pending U.S. patent application Ser. No. 12/631,412, entitled "Thermal Energy Conversion Device," filed on Dec. 9, 2009, the contents of which are hereby incorporated by reference to the extent not inconsistent with the present disclosure.

In one or more exemplary embodiments, the inlet pressure at the first compression stage 123 may exceed the vapor pressure of the working fluid by a margin sufficient to prevent vaporization of the working fluid at the local regions of the low pressure and/or high velocity. Consequently, a traditional passive pressurization system, such as one that employs a surge tank which only provides the incremental pressure of gravity relative to the fluid vapor pressure, may prove insufficient for the exemplary embodiments disclosed herein. Alternatively, to maximize the power output of the cycle, the discharge pressure of the turbine and inlet pressure of the compressor may need to be reduced below the vapor pressure of the working fluid, at which point a passive pressurization system is unable to function properly as a pressure control device.

The exemplary embodiments disclosed herein may further include the incorporation and use of a mass management system (MMS) in connection with or integrated into the described thermodynamic cycles 100-600. The MMS may be provided to control the inlet pressure at the first compression stage 123 by adding and removing mass (i.e., working fluid) from the working fluid circuit 100-600, thereby increasing the efficiency of the cycles 100-600. In one exemplary embodiment, the MMS operates with the cycle 100-600 semi-passively and uses sensors to monitor pressures and temperatures within the high pressure side (from the final compression stage 125 outlet to expander 112, 114 inlet) and low pressure side (from expander 112, 114 outlet to first compression stage 123 inlet) of the circuit 110-610. The MMS may also include valves, tank heaters or other equipment to facilitate the movement of the working fluid into and out of the working fluid circuits 110-610 and a mass control tank for storage of working fluid. Exemplary embodiments of the MMS are illustrated and described in co-pending U.S. patent application Ser. Nos. 12/631,412; 12/631,400; and 12/631,379 each filed on Dec. 4, 2009; U.S. patent application Ser. No. 12/880,428, filed on Sep. 13, 2010, and PCT Application No. US2011/29486, filed on Mar. 22, 2011. The contents of each of the foregoing cases are incorporated by reference herein to the extent consistent with the present disclosure.

Figure 7:
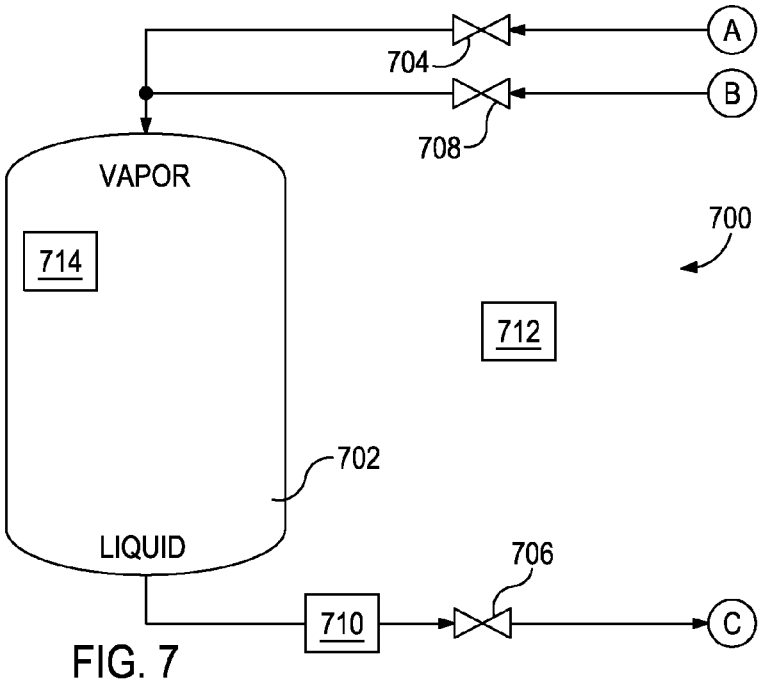
FIG. 7 schematically illustrates an exemplary embodiment of a mass management system (MMS) which can be implemented with a heat engine cycle, according to one or more embodiments disclosed.
Figure 8:
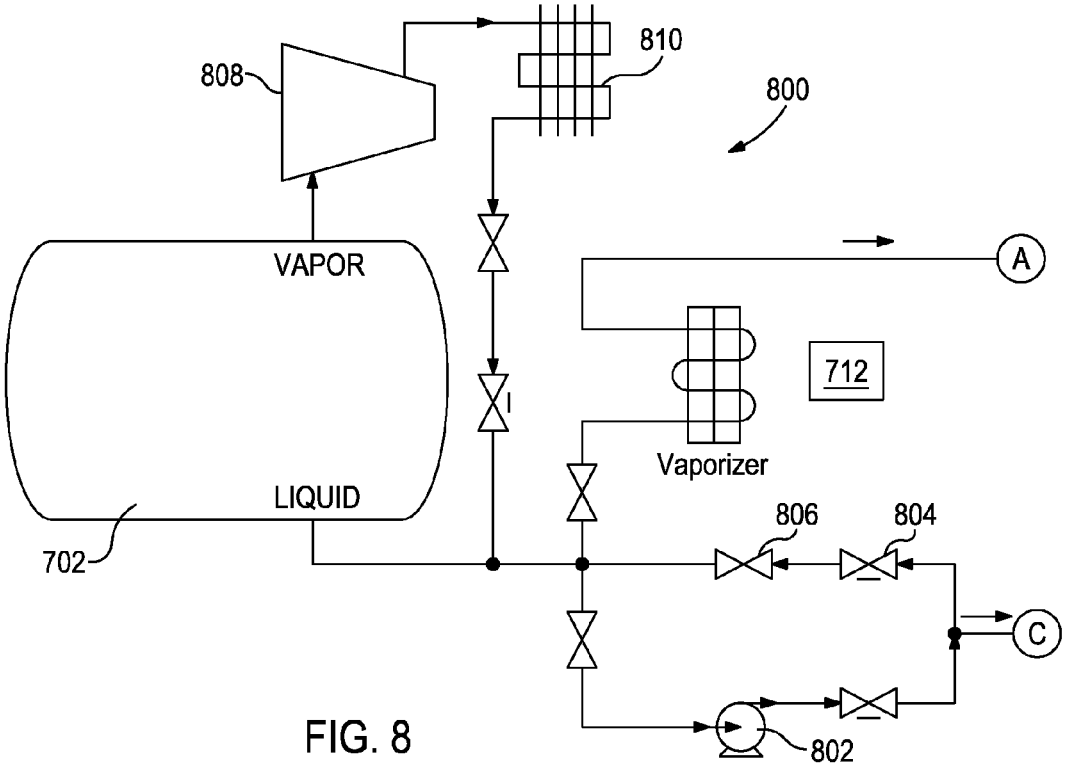
FIG. 8 schematically illustrates another exemplary embodiment of a MMS which can be implemented with a heat engine cycle, according to one or more embodiments disclosed.

Referring now to FIGS. 7 and 8, illustrated are exemplary mass management systems 700 and 800, respectively, which may be used in conjunction with the thermodynamic cycles 100-600 described herein, in one or more exemplary embodiments. System tie-in points A, B, and C as shown in FIGS. 7 and 8 (only points A and C shown in FIG. 8) correspond to the system tie-in points A, B, and C shown in FIGS. 1-6. Accordingly, MMS 700 and 800 may each be fluidly coupled to the thermodynamic cycles 100-600 of FIGS. 1-6 at the corresponding system tie-in points A, B, and C (if applicable). The exemplary MMS 800 stores a working fluid at low (sub-ambient) temperature and therefore low pressure, and the exemplary MMS 700 stores a working fluid at or near ambient temperature. As discussed above, the working fluid may be $CO_2$, but may also be other working fluids without departing from the scope of the disclosure.

In exemplary operation of the MMS 700, a working fluid storage tank 702 is pressurized by tapping working fluid from the working fluid circuit(s) 110-610 through a first valve 704 at tie-in point A. When needed, additional working fluid may be added to the working fluid circuit(s) 110-610 by opening a second valve 706 arranged near the bottom of the storage tank 702 in order to allow the additional working fluid to flow through tie-in point C, arranged upstream from the first compression stage 123 (FIGS. 1-6). Adding working fluid to the circuit(s) 110-610 at tie-in point C may serve to raise the inlet pressure of the first compression stage 123. To extract fluid from the working fluid circuit(s) 110-610, and thereby decrease the inlet pressure of the first compression stage 123, a third valve 708 may be opened to permit cool, pressurized fluid to enter the storage tank via tie-in point B. While not necessary in every application, the MMS 700 may also include a transfer pump/compressor 710 configured to remove working fluid from the tank 702 and inject it into the working fluid circuit(s) 110-610.

The MMS 800 of FIG. 8 uses only two system tie-ins or interface points A and C. The valve-controlled interface A is not used during the control phase (e.g., the normal operation of the unit), and is provided only to pre-pressurize the working fluid circuit(s) 110-610 with vapor so that the temperature of the circuit(s) 110-610 remains above a minimum threshold during fill. A vaporizer may be included to use ambient heat to convert the liquid-phase working fluid to approximately an ambient temperature vapor-phase of the working fluid. Without the vaporizer, the system could decrease in temperature dramatically during filling. The vaporizer also provides vapor back to the storage tank 702 to make up for the lost volume of liquid that was extracted, and thereby acting as a pressure-builder. In at least one embodiment, the vaporizer can be electrically-heated or heated by a secondary fluid. In operation, when it is desired to increase the suction pressure of the first compression stage 123 (FIGS. 1-6), working fluid may be selectively added to the working fluid circuit(s) 110-610 by pumping it in with a transfer pump/compressor 802 provided at or proximate tie-in C. When it is desired to reduce the suction pressure of the first compression stage 123, working fluid is selectively extracted from the system at interface C and expanded through one or more valves 804 and 806 down to the relatively low storage pressure of the storage tank 702.

Under most conditions, the expanded fluid following the valves 804, 806 will be two-phase (i.e., vapor+liquid). To prevent the pressure in the storage tank 702 from exceeding its normal operating limits, a small vapor compression refrigeration cycle, including a vapor compressor 808 and accompanying condenser 810, may be provided. In other embodiments, the condenser can be used as the vaporizer, where condenser water is used as a heat source instead of a heat sink. The refrigeration cycle may be configured to decrease the temperature of the working fluid and sufficiently condense the vapor to maintain the pressure of the storage tank 702 at its design condition. As will be appreciated, the vapor compression refrigeration cycle may be integrated within MMS 800, or may be a stand-alone vapor compression cycle with an independent refrigerant loop.

The working fluid contained within the storage tank 702 will tend to stratify with the higher density working fluid at the bottom of the tank 702 and the lower density working fluid at the top of the tank 702. The working fluid may be in liquid phase, vapor phase or both, or supercritical; if the working fluid is in both vapor phase and liquid phase, there will be a phase boundary separating one phase of working fluid from the other with the denser working fluid at the bottom of the storage tank 702. In this way, the MMS 700, 800 may be capable of delivering to the circuits 110-610 the densest working fluid within the storage tank 702.

All of the various described controls or changes to the working fluid environment and status throughout the working fluid circuits 110-610, including temperature, pressure, flow direction and rate, and component operation such as compression stages 123-125, secondary compressor 126, and turbines 112, 114, may be monitored and/or controlled by a control system 712, shown generally in FIGS. 7 and 8. Exemplary control systems compatible with the embodiments of this disclosure are described and illustrated in co-pending U.S. patent application Ser. No. 12/880,428, entitled "Heat Engine and Heat to Electricity Systems and Methods with Working Fluid Fill System," filed on Sep. 13, 2010, and incorporated by reference, as indicated above.

In one exemplary embodiment, the control system 712 may include one or more proportional-integral-derivative (PID) controllers as control loop feedback systems. In another exemplary embodiment, the control system 712 may be any microprocessor-based system capable of storing a control program and executing the control program to receive sensor inputs and generate control signals in accordance with a predetermined algorithm or table. For example, the control system 712 may be a microprocessor-based computer running a control software program stored on a computer-readable medium. The software program may be configured to receive sensor inputs from various pressure, temperature, flow rate, etc. sensors positioned throughout the working fluid circuits 110-610 and generate control signals therefrom, wherein the control signals are configured to optimize and/or selectively control the operation of the circuits 110-610.

Each MMS 700, 800 may be communicably coupled to such a control system 712 such that control of the various valves and other equipment described herein is automated or semi-automated and reacts to system performance data obtained via the various sensors located throughout the circuits 110-610, and also reacts to ambient and environmental conditions. That is to say that the control system 712 may be in communication with each of the components of the MMS 700, 800 and be configured to control the operation thereof to accomplish the function of the thermodynamic cycle(s) 100-600 more efficiently. For example, the control system 712 may be in communication (via wires, RF signal, etc.) with each of the valves, pumps, sensors, etc. in the system and configured to control the operation of each of the components in accordance with a control software, algorithm, or other predetermined control mechanism. This may prove advantageous to control temperature and pressure of the working fluid at the inlet of the first compression stage 123, to actively increase the suction pressure of the first compression stage 123 by decreasing compressibility of the working fluid. Doing so may avoid damage to the first compression stage 123 as well as increase the overall pressure ratio of the thermodynamic cycle(s) 100-600, thereby improving the efficiency and power output.

In one or more exemplary embodiments, it may prove advantageous to maintain the suction pressure of the first compression stage 123 above the boiling pressure of the working fluid at the inlet of the first compression stage 123. One method of controlling the pressure of the working fluid in the low-temperature side of the working fluid circuit(s) 110-610 is by controlling the temperature of the working fluid in the storage tank 702 of FIG. 7. This may be accomplished by maintaining the temperature of the storage tank 702 at a higher level than the temperature at the inlet of the first compression stage 123. To accomplish this, the MMS 700 may include the use of a heater and/or a coil 714 within the tank 702. The heater/coil 714 may be configured to add or remove heat from the fluid/vapor within the tank 702. In one exemplary embodiment, the temperature of the storage tank 702 may be controlled using direct electric heat. In other exemplary embodiments, however, the temperature of the storage tank 702 may be controlled using other devices, such as but not limited to, a heat exchanger coil with pump discharge fluid (which is at a higher temperature than at the pump inlet), a heat exchanger coil with spent cooling water from the cooler/condenser (also at a temperature higher than at the pump inlet), or combinations thereof.

Figure 9:
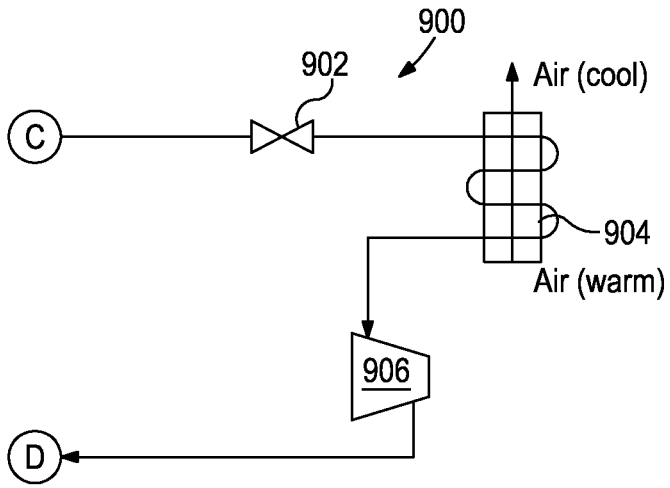
FIGS. 9 and 10 schematically illustrate different system arrangements for inlet chilling of a separate stream of fluid (e.g., air) by utilization of the working fluid which can be used in parallel heat engine cycles disclosed herein.
Figure 10:
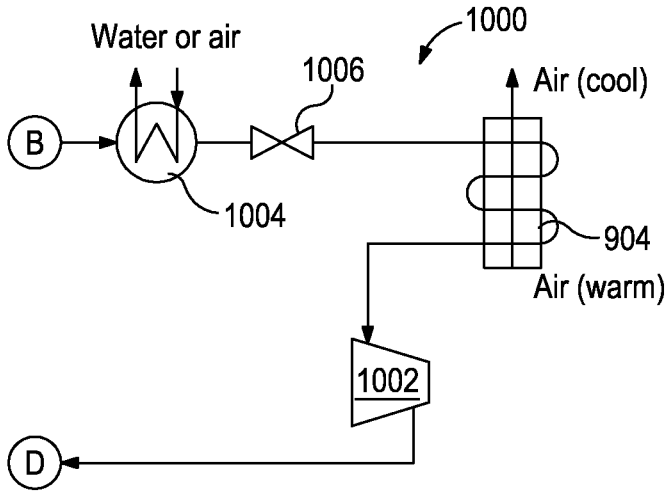

Referring now to FIGS. 9 and 10, chilling systems 900 and 1000, respectively, may also be employed in connection with any of the above-described cycles in order to provide cooling to other areas of an industrial process including, but not limited to, pre-cooling of the inlet air of a gas-turbine or other air-breathing engines, thereby providing for a higher engine power output. System tie-in points B and D or C and D in FIGS. 9 and 10 may correspond to the system tie-in points B, C, and D in FIGS. 1-6. Accordingly, chilling systems 900, 1000 may each be fluidly coupled to one or more of the working fluid circuits 110-610 of FIGS. 1-6 at the corresponding system tie-in points B, C, and/or D (where applicable).

In the chilling system 900 of FIG. 9, a portion of the working fluid may be extracted from the working fluid circuit(s) 110-610 at system tie-in C. The pressure of that portion of fluid is reduced through an expansion device 902, which may be a valve, orifice, or fluid expander such as a turbine or positive displacement expander. This expansion process decreases the temperature of the working fluid. Heat is then added to the working fluid in an evaporator heat exchanger 904, which reduces the temperature of an external process fluid (e.g., air, water, etc.). The working fluid pressure is then re-increased through the use of a compressor 906, after which it is reintroduced to the working fluid circuit(s) 110-610 via system tie-in D. In various embodiments, the fluid extraction point C, may be after any of the intercoolers 121, 122 as may prove advantageous thermodynamically.

The compressor 906 may be either motor-driven or turbine-driven off either a dedicated turbine or an additional wheel added to a primary turbine of the system. In other exemplary embodiments, the compressor 906 may be integrated with the main working fluid circuit(s) 110-610. In yet other exemplary embodiments, the function of compressor 906 may be integrated with one or more of the compression stages 123-125. In yet other exemplary embodiments, the compressor 906 may take the form of a fluid ejector, with motive fluid supplied from system tie-in point A, and discharging to system tie-in point D, upstream from the pre-cooler 120 (FIGS. 1-6).

The chilling system 1000 of FIG. 10 may also include a compressor 1002, substantially similar to the compressor 906, described above. The compressor 1002 may take the form of a fluid ejector, with motive fluid supplied from working fluid cycle(s) 110-610 via tie-in point A (not shown, but corresponding to point A in FIGS. 1-6), and discharging to the cycle(s) 110-610 via tie-in point D. In the illustrated exemplary embodiment, the working fluid is extracted from the circuit(s) 110-610 via tie-in point B and pre-cooled by a heat exchanger 1004 prior to being expanded in an expansion device 1006, similar to the expansion device 902 described above. In one exemplary embodiment, the heat exchanger 1004 may include a water-$CO_2$, or air-$CO_2$ heat exchanger. As can be appreciated, the addition of the heat exchanger 1004 may provide additional cooling capacity above that which is capable with the chilling system 900 shown in FIG. 9.

The terms "upstream" and "downstream" as used herein are intended to more clearly describe various exemplary embodiments and configurations of the disclosure. For example, "upstream" generally means toward or against the direction of flow of the working fluid during normal operation, and "downstream" generally means with or in the direction of the flow of the working fluid curing normal operation.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A system for converting thermal energy to work in high ambient temperature conditions, comprising:

first and second compression stages fluidly coupled together such that the first compression stage is upstream of the second compressor stage, the first and second compression stages being configured to compress a working fluid in a working fluid circuit, the working fluid being separated into a first mass flow and a second mass flow downstream from the second compression stage;

an intercooler disposed upstream from the second compression stage and downstream from the first compression stage;

first and second heat exchangers coupled to a source of heat and disposed downstream from the second compression stage, the first heat exchanger being configured to transfer heat from the source of heat to the first mass flow and the second heat exchanger configured to transfer heat from the source of heat to the second mass flow;

first and second turbines, the first turbine configured to receive the first mass flow from the first heat exchanger and the second turbine configured to receive the second mass flow from the second heat exchanger;

a first recuperator disposed downstream from the first turbine on a high temperature side of the working fluid circuit and between the second compression stage and the second turbine on a low temperature side of the working fluid circuit, the first recuperator being configured to transfer heat from the working fluid on the high temperature side to working fluid on the low temperature side; and a second recuperator disposed downstream from the second turbine on the high temperature side and between the second compression stage and the second turbine on the low temperature side, the second recuperator being configured to transfer heat from the working fluid on the high temperature side to working fluid on the low temperature side.

2. The system of claim 1, further comprising:

a third compression stage disposed downstream from the second compression stage and configured to further compress the working fluid; and a second intercooler interposed between the second and third compressions stages.

3. The system of claim 1, further comprising a precooler disposed upstream from the first compression stage and configured to cool a combined flow of the first and second mass flows, wherein at least one of the precooler and the intercooler is configured to receive a heat transfer medium from an ambient environment, and a temperature of the ambient environment is between about 30° C. and about 50° C.

4. The system of claim 1, wherein the first and second mass flow of the working fluid on the low temperature side upstream from the at least one of the first and second recuperators has a temperature of between about 50° C. and about 70° C.

5. The system of claim 1, wherein the combined first and second mass flow of the working fluid on high temperature side downstream from the second recuperator and upstream from the precooler has a temperature of between about 70° C. and about 110° C.

6. The system of claim 1, wherein the heat source is a waste heat stream.

7. The system of claim 1, wherein the working fluid is carbon dioxide.

8. The system of claim 1, wherein the working fluid is at a supercritical state at an inlet of the first compression stage.

9. The system of claim 1, wherein the first and second heat exchangers are arranged in series in the heat source.

10. The system of claim 1, wherein, on the high temperature side, the first mass flow downstream from the first recuperator and the second mass flow upstream from the second recuperator are combined and introduced to the second recuperator.

11. The system of claim 1, wherein, on the high temperature side, the first mass flow downstream from the first recuperator and the second mass flow downstream from the second recuperator are combined and introduced to the precooler.

12. The system of claim 1, further comprising a mass management system operatively connected to the working fluid circuit via at least two tie-in points, the mass management system being configured to control the amount of working fluid within the working fluid circuit.

13. A system for converting thermal energy to work, comprising:

a plurality of compression stages fluidly coupled together in series and configured to compress and circulate a working fluid in a working fluid circuit having a low pressure side and a high pressure side;

one or more intercoolers, each being disposed between two of the plurality of compression stages and configured to cool the working fluid, at least one of the one or more intercoolers being configured to receive a heat transfer medium from an ambient environment, the ambient environment having a temperature of between about 30° C. and about 50° C.;

first and second heat exchangers fluidly coupled in series to a source of heat and fluidly coupled to the working fluid circuit, the first heat exchanger configured to receive a first mass flow of the working fluid and second heat exchanger configured to receive a second mass flow of the working fluid;

a first turbine configured to receive the first mass flow of working fluid from the first heat exchanger;

a second turbine configured to receive the second mass flow of working fluid from the second heat exchanger, wherein the plurality of compression stages and the one or more intercoolers are disposed upstream of the first heat exchanger, the second heat exchanger, the first turbine, and the second turbine on the low pressure side of the working fluid circuit; and a plurality of recuperators, the plurality of recuperators being configured to transfer heat from the first mass flow downstream from the first turbine to working fluid upstream from the first heat exchanger, and configured to transfer heat from at least the second mass flow downstream from the second turbine to at least the second mass flow upstream from the second heat exchanger.

14. The system of claim 13, wherein the plurality of recuperators comprise first and second recuperators coupled together in series on a high temperature side of the working fluid circuit and disposed in parallel on a low temperature side of the working fluid circuit, wherein the first recuperator receives the first mass flow from the first turbine, and the second recuperator receives the first mass flow from the first recuperator and the second mass flow from the second turbine.

15. The system of claim 13, wherein the first and second recuperators are fluidly coupled in parallel on a high temperature side of the working fluid circuit and on a low temperature side of the working fluid circuit.

16. The system of claim 13, further comprising a precooler disposed upstream from the first compression stage and configured to receive and cool a combined flow of the first and second mass flows.

17. The system of claim 16, wherein a combined flow of the first and second mass flows on the high temperature side, upstream from the precooler and downstream from the plurality of recuperators, has a temperature of between about 70° C. and about 110° C.

18. The system of claim 13, wherein the first and second mass flows of the working fluid on the low temperature side, upstream from the plurality of recuperators, have a temperature of between about 50° C. and about 70° C.

19. The system of claim 13, wherein the heat source is a waste heat stream and the working fluid is carbon dioxide, the carbon dioxide being at a supercritical state at an inlet to the first compression stage.

20. The system of claim 13, wherein the plurality of recuperators comprises a single recuperator component.

21. A system for converting thermal energy to work in a high ambient temperature environment, comprising:

a working fluid circuit having a high temperature side and a low temperature side, the working fluid circuit containing a working fluid comprising carbon dioxide;

a precooler configured to receive the working fluid from the high temperature side;

a compressor having a plurality of stages and one or more intercoolers configured to cool the working fluid between at least two of the plurality of stages, the compressor configured to receive the working fluid from the precooler, wherein at least one of the precooler and the one or more intercoolers is configured to receive a heat transfer medium from the ambient environment, the ambient environment having a temperature of between about 30° C. and about 50° C.;

a plurality of heat exchangers coupled to a source of heat, the plurality of heat exchangers being configured to receive fluid from the low temperature side and discharge fluid to the high temperature side;

a plurality of turbines disposed on the high temperature side of the working fluid circuit, each of the plurality of turbines being coupled to one or more of the plurality of heat exchangers and configured to receive heated working fluid therefrom; and a plurality of recuperators, each of the plurality of recuperators being coupled the high and low temperature sides of the working fluid circuit, the plurality of recuperators being coupled, on the high temperature side, to at least one of the plurality of turbines and to the precooler and, on the low temperature side, to the compressor and at least one of the plurality of heat exchangers, the plurality of recuperators being configured to transfer heat from the high temperature side, downstream from at least one of the plurality of turbines, to the working fluid, upstream from at least one of the plurality of heat exchangers.

* * * * *